United States Patent [19]

Watabe et al.

[11] Patent Number: 4,841,267

[45] Date of Patent: Jun. 20, 1989

[54] DEFLECTION APPARATUS FOR CATHODE RAY TUBE

[75] Inventors: Seiji Watabe; Isao Yokoyama; Tsutomu Maeda; Koichi Shibuya; Sumio Takahashi, all of Tokyo, Japan

[73] Assignee: TDK Corporation, Tokyo, Japan

[21] Appl. No.: 240,145

[22] Filed: Aug. 26, 1988

[51] Int. Cl.[4] ..... H01F 7/00

[52] U.S. Cl. ..... 335/210; 335/213

[58] Field of Search ..... 335/210, 212, 213

[56] References Cited

U.S. PATENT DOCUMENTS 4,117,432 9/1978 Shizu ..... 335/213 X 4,175,261 11/1979 Sawada ..... 335/213 X 4,260,974 4/1981 Nelle ..... 335/213

*Primary Examiner*—George Harris

*Attorney, Agent, or Firm*—Wood, Dalton, Phillips, Mason & Rowe

[57] ABSTRACT

A deflection apparatus for cathode ray tube is provided, which comprises deflection yoke with guide grooves, deflection windings for scanning in one direction in said grooves, deflection windings for scanning in the other direction and an insulator between both types of windings. It attains high accuracy deflection with less distortion without any induced heating problem due to protuberances made relatively between grooves.

3 Claims, 2 Drawing Sheets

DEFLECTION APPARATUS FOR CATHODE RAY TUBE

BACKGROUND OF THE INVENTION

1. Field of the Invention

The present invention relates to a deflection apparatus for cathode ray tube of a display, and more particularly it relates to a deflection apparatus for cathode ray tube which shows deflection distortion.

2. Description of the Prior Art

A deflection apparatus for cathode ray tube comprises fundamentally of vertical scanning coils and horizontal scanning coils. There are three basic types of deflection apparatus for cathode ray tube well known in the prior art, which are classified as follows:

(1) A saddle type, in which windings on bobbin are made to form saddle-shaped coils and arranged on the inner surface of the deflection yoke itself.

(2) A semi-toroidal type, in which horizontal scanning coils are prepared in the same manner as the above saddle type, and vertical scanning coils are directly formed toroidally on the surface of the deflection yoke itself.

(3) A slot type, which is one variation of the aforesaid saddle type, in which plural grooves are formed in the radial direction in the deflection yoke and windings are mounted therein.

Among these three, the semi-toroidal type of (2) is the mainstream of the applied for deflection yokes because they result in high efficiency and low resistance for direct current.

An example of the semi-toroidal deflection apparatus in the prior art will now be described with reference to the accompanying drawings of FIG. 1 and FIG. 2. Referring to the drawings, a trumpet-shaped deflection yoke (1) is made of a ferrite core and vertical scanning windings (2) are wound thereabout to form a toroid. A trumpet-shaped insulator (3) is arranged on the inner surface of the deflection yoke (1) and saddle type horizontal scanning coils are arranged thereon. The insulator (3) holds the horizontal scanning coils and at the same time, it holds the deflection yoke too.

As is illustrated in FIG. 1 and FIG. 2, a magnetic field is vertically generated by the horizontal scanning coils and forms a loop of magnetic field through the deflection yoke (1). However, as the vertical scanning windings (17) are arranged in the horizontal magnetic field, eddy-current by the horizontal field is induced on the surface of the vertical windings and causes heat generating problems. In the recent high resolution cathode ray tubes, as they employ a higher frequency to drive horizontal scanning coils at for example 64–120 kHz, the tendency to generate heat is increased. Not only for the semi-toroidal type, two deflection windings generally have an induction heating problem when one of the deflection winding is heated by the magnetic field generated by the other windings.

One or both horizontal scanning coils and vertical scanning coils, or a deflection apparatus for cathode ray tube, which are assembled from these coils on trumpet-shaped ferrite core, are generally supported on a plastic resin frame. Heretofore, it was necessary to employ an expensive heat-resistant plastic material when temperature of the material might rise to or above about 90° C.

THE PURPOSE OF THE INVENTION

The present invention is intended to overcome the previously stated overheating problem in deflection apparatus for cathode ray tube. Another object of the present invention is to provide a deflection apparatus for high precision cathode ray tube which can prevent overheating.

THE SUMMARY OF THE INVENTION

This object is accomplished in accordance with the present invention by a deflection apparatus for cathode ray tube, of a type which includes horizontal scanning coils and vertical scanning coils arranged on the trumpet-shaped deflection yoke, which is characterized by comprising:

a trumpet-shaped deflection yoke on the inner surface of which plural guide grooves are formed in the direction of axis of cathode ray tube, one of the horizontal and vertical scanning coils arranged in the aforesaid guide grooves, a trumpet-shaped insulator arranged on the inner surface of the aforesaid deflection yoke and the other scanning coils arranged on the inner surface of the aforesaid insulator.

In the deflection apparatus of the present invention, deflection windings which are arranged in the aforesaid guide grooves on the inner surface of the deflection yoke are scarcely affected by the magnetic field generated by deflection windings which are arranged on the inner surface of the insulator because the magnetic field from the latter windings directly penetrates into the protuberances relatively formed between the grooves on the deflection yoke. As a result, the heat generation caused by eddy-current loss due to the induction between the windings is decreased, and accordingly, expensive heat-resistant plastic materials need not be employed as the insulator. It is another attainment of the present invention that a high resolution cathode ray tube can be manufactured because the guide grooves on the deflection yoke precisely regulate the position of the deflection windings which are mounted thereon. Furthermore, in another preferred embodiment, hooks may be formed on both opening ends of the trumpet-shaped insulator to support the deflection windings for the other direction in order to increase the accuracy of assembly.

THE BRIEF DESCRIPTION OF THE FIGURES

The present invention will now be described further with reference to preferred embodiments. In the following examples, description are given only on the semi-saddle type. However, variations such as exchanging the arrangement of vertical scanning coils and horizontal scanning coils of the example of the preferred embodiment may be made by one skilled in the art without departing from the spirit and the scope of the present invention. The present invention may also be applied to the saddle-saddle type. Moreover, in the following examples, description will be given for such a case as the number of turns of winding for vertical scanning coils being smaller than that for horizontal scanning coil. However in the high frequency use, the number of turns of winding for vertical scanning coils may be larger. Also such case is included in the scope of the present invention.

DESCRIPTION OF THE PREFERRED EMBODIMENT

Figure 1:
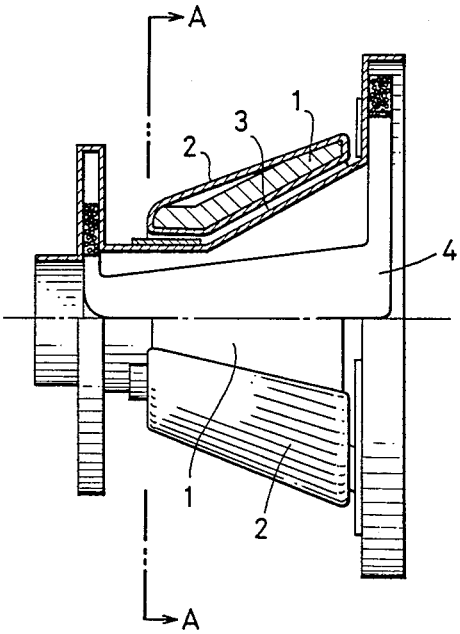
FIG. 1 PRIOR ART
FIG. 1 illustrates a cross-sectional view of an example of a deflection apparatus in the prior art, which is cut along the direction of axis of cathode ray tube.
Figure 2:
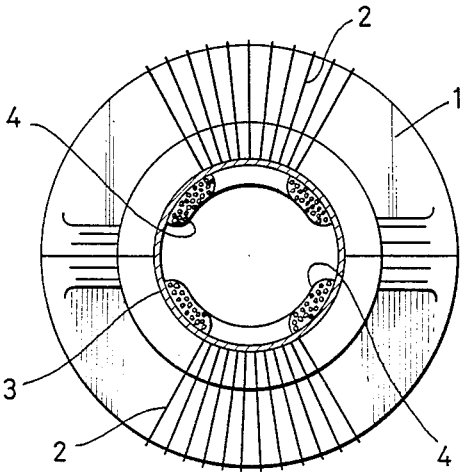
FIG. 2 PRIOR ART
FIG. 2 illustrates the other cross-sectional view of the deflection apparatus in FIG. 1 which is cut along the line A—A in FIG. 1.
Figure 3:
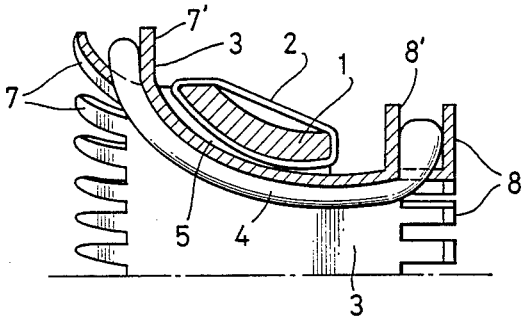
FIG. 3 illustrates a cross-sectional view of an example of a deflection apparatus of the present invention.

FIG. 3 illustrates a cross-sectional view of an example of a deflection apparatus of the present invention. As it fundamentally corresponds to the deflection apparatus in FIG. 1, the same reference numbers are given to similar members for these figures. Herein, the deflection apparatus comprises: a trumpet-shaped deflection yoke (1), toroidal-shaped vertical scanning winding (2) which wound around the aforesaid deflection yoke (1), a trumpet-shaped insulator (3) which is arranged on the inner surface of the aforesaid deflection yoke (1) and saddle type deflection winding (4) which is arranged on the inner surface of the aforesaid insulator (3). The insulator (3) is made of plastic resin to support not only the horizontal scanning windings, but also deflection yoke therewith.

Figure 4:
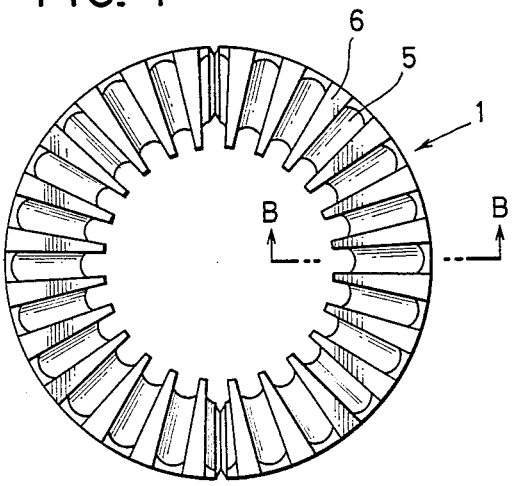
FIG. 4 illustrates an inside view of the deflection yoke of deflection apparatus in FIG. 3.
Figure 5:
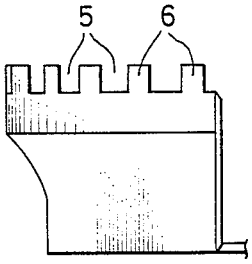
FIG. 5 illustrates a part of outside view of deflection yoke in FIG. 4.
Figure 6:
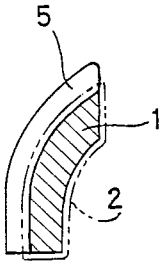
FIG. 6 illustrates a cross-sectional view of deflection yoke in FIG. 4 which is cut along the line B—B in FIG. 4.

The deflection yoke which embodies the present invention is illustrated in FIG. 4, 5 and 6. The deflection yoke of the present invention has spaced plural guide grooves on the inner surface of it, which extend in the direction of the axis of the cathode ray tube. In the area between the grooves, protuberances (6) are formed. The vertical deflection windings (2) are contained in the aforesaid grooves (5). The number of turns of the windings to be assigned to each groove (5) is decided in order to meet the specification of the deflection coil for manufacturing the deflection apparatus to attain the precise electro-magnetic deflection and good repeatability in production. As is illustrated in FIG. 6, the vertical windings (2) do not protrude from the surface of the deflection yoke due to grooves. Hence, the magnetic field which is generated by the horizontal scanning coils can directly penetrate into protuberances (6) of the deflection yoke when they are assembled as in FIG. 3. A similar kind of the deflection yoke illustrated in FIGS. 4–6, were applied in the prior art for slot type of deflection apparatus as formerly described. However, it should be taken heed that the manner of usage in the prior technique was much different from that of the present invention. That is to say, in the deflection apparatus in the prior art, though two kinds of winding were arranged in the grooves on the same yoke, a complicated composition was employed such that an insulating spacer as interposition inserted into each groove for the insulation of each winding after one of the winding was settled. In spite of high accuracy of the deflection apparatus of this complicated type, it resulted in high production costs.

The trumpet-shaped plastic resin insulator (3) which is arranged onto the inner surface of the deflection yoke (1) contains the horizontal scanning windings along the inner surface of it. In this case of embodiment, it is preferred to provide hooks at predetermined intervals at both ends of the insulator (3) to support the vertical scanning coils thereon. Due to the employment of this type of insulator, high precision electro-magnetic deflection can be attained with good repeatability by setting a predetermined appropriate relationship between positions of windings and hooks, and number of windings.

As another embodiment of the present invention, the vertical scanning coils may be made to form that of saddle type utilizing the grooves on the deflection yoke. The effect and result are the same as the aforementioned embodiment.

With the manner described above, deflection apparatus was made and measured for heat generation. Inductances of employed horizontal scanning coils and vertical scanning coils were 90 uH (LH) and 6 mH (LV) respectively and measured sweep frequencies for horizontal and vertical scanning were 64 kHz and 60 Hz respectively. The deflection apparatus was assembled on a cathode ray tube with 20 inch and 90° deflection angle. The rising temperature $\Delta T$ at the vertical scanning coil was measured and listed in the the following table. For the comparison, the semi-toroidal type and the saddle-saddle type deflection coils in the prior art were also measured to list therein.

type of scanning apparatus: $\Delta T$
Semi-toroidal type: 27° C.
Saddle-saddle type: 25° C.
Present invention: 20° C.

Herein, $\Delta T$ is the rising temperature at vertical scanning coil.

As is shown in the table, the deflection apparatus incorporated with the present invention can successfully prevent rising temperature by induced heating. In addition to above improvement, it can be manufactured with better repeatability in production for more precise magnetic field determined by the accuracy of deflection yoke in comparison with the saddle-saddle type and the toroidal-saddle type ( semi-toroidal type ) because one of windings is arranged in the guide grooves of the deflection yoke itself.

Furthermore, to improve the scanning apparatus of the present invention to the level comparable to that of the type of which both windings are arranged in the grooves on the deflection yoke, hooks may be formed on the periphery of the opening ends of the trumpet-shaped insulator to retain specified turns of the deflection windings on respective hooks of predetermined specified addresses. In accordance with this further improvement, both orthogonal scanning coils can be made to generate an accurate magnetic field and to attain the reliable insulation without any problems which were experienced in the prior art.

What is claimed is:

1. A deflection apparatus for cathode ray tube characterized by comprising:

(a) a trumpet-shaped deflection yoke having plural guide grooves on the inner surface extending generally in the direction of axis of cathode ray tube for retaining scanning windings therein, (b) one of the horizontal and vertical scanning windings retained in said guide grooves, (c) a trumpet-shaped insulator which is arranged on the inner surface of said deflection yoke and (d) the other scanning windings arranged on the inner surface of said insulator.

2. A deflection apparatus for cathode ray tube of claim 1, wherein said windings retained in said guide grooves are vertical scanning coil.

3. A deflection apparatus for cathode ray tube of claim 1, wherein hooks are provided at predetermined intervals on the periphery of said trumpet-shaped insulator and the horizontal scanning coils are supported thereon.

* * * * *